US011654441B2

(12) United States Patent
Wey et al.

(10) Patent No.: US 11,654,441 B2
(45) Date of Patent: May 23, 2023

(54) TEMPERATURE-CONTROLLED TRAMP METAL SEPARATION ASSEMBLY

(71) Applicant: TAI HAN EQUIPMENT ENTERPRISE CO., LTD., Taipei (TW)

(72) Inventors: Shyh-Yi Wey, Taipei (TW); Wen-Cheng Chang, Taipei (TW); Ken-Der Lin, Taipei (TW); Bao-Ding Li, Taipei (TW); Kuen Ting Hsieh, Taipei (TW)

(73) Assignee: TAI HAN EQUIPMENT ENTERPRISE CO., LTD., Taipei (TW)

( * ) Notice: Subject to any disclaimer, the term of this patent is extended or adjusted under 35 U.S.C. 154(b) by 0 days.

(21) Appl. No.: 17/183,806

(22) Filed: Feb. 24, 2021

(65) Prior Publication Data

US 2021/0339268 A1 Nov. 4, 2021

(30) Foreign Application Priority Data

Apr. 29, 2020 (TW) ..... 109114395

(51) Int. Cl.
*B03C 1/28* (2006.01)
*B03C 1/02* (2006.01)
(Continued)

(52) U.S. Cl.
CPC ..... *B03C 1/284* (2013.01); *B03C 1/0332* (2013.01); *B03C 1/286* (2013.01); *B03C 2201/20* (2013.01)

(58) Field of Classification Search
CPC ..... B03C 1/284; B03C 1/286; B03C 2201/28
(Continued)

(56) References Cited

U.S. PATENT DOCUMENTS 6,062,393 A * 5/2000 Knoll ..... B03C 1/14 209/11
6,250,475 B1 * 6/2001 Kwasniewicz ..... B03C 1/284 209/229

(Continued)

FOREIGN PATENT DOCUMENTS

CN 203018189 U * 6/2013
CN 204602393 U 9/2015

(Continued)

OTHER PUBLICATIONS

Kangsheng; Xu, 'Full-Automatic Strong Magnetism Magnetic Separator De-ironing' (English Translation), Sep. 2015, worldwide.espacenet.com (Year: 2015).*

(Continued)

*Primary Examiner* — Michael McCullough
*Assistant Examiner* — Molly K Devine
(74) *Attorney, Agent, or Firm* — Birch, Stewart, Kolasch & Birch, LLP

(57) ABSTRACT

A temperature-controlled tramp metal separation assembly includes a core rod and a magnetic set. The core rod is made of non-magnetic materials and includes a chamber, a first end with an air inlet, and a second end with an air outlet. The magnetic set includes a plurality of magnetic members and a plurality of spacers respectively disposed between the two adjacent magnetic members. The magnetic set is nested in the chamber in a way that an air path is formed therein so that an external cooling air flow can be introduced from the air inlet, and then discharged from the air outlet via the air path. Thus, the operating temperature of the tramp metal separating process can be maintained at an acceptable level, preventing the magnetic force of the magnet set from being reduced.

7 Claims, 11 Drawing Sheets

(51) Int. Cl.

| | |
|---|---|
| ***B03C 1/30*** | (2006.01) |
| ***F25D 17/04*** | (2006.01) |
| ***F25D 29/00*** | (2006.01) |
| ***B03C 1/033*** | (2006.01) |

(58) Field of Classification Search
USPC ..... 209/223.3
See application file for complete search history.

(56) References Cited

U.S. PATENT DOCUMENTS

| | | | |
|---|---|---|---|
| 8,132,674 | B1 | 3/2012 | Allore et al. |
| 2008/0283447 | A1 | 11/2008 | Grey et al. |

FOREIGN PATENT DOCUMENTS

| | | | | | |
|---|---|---|---|---|---|
| CN | 209438817 | U | | 9/2019 | |
| JP | 2004-16938 | A | | 1/2004 | |
| JP | 2004-016938 | A | | 1/2004 | |
| JP | 2004148150 | A | * | 5/2004 | |
| JP | 2006035113 | A | * | 2/2006 | |
| JP | 2010-172823 | A | | 8/2010 | |
| TW | M576075 | U | | 4/2019 | |
| WO | WO-2014098040 | A1 | * | 6/2014 | ..... B03C 1/0332 |

OTHER PUBLICATIONS

Takahiko; Mozume, 'Permanent Magnet Magnetic Rod with Inclined Magnet Yoke Structure and Magnetic Iron Removing Device' (English Translation), Jun. 2013, patents.google.com (Year: 2013).*

Sazawa; Masaharu, 'Magnetic In-Line Filter' (English Translation), Jun. 2014, worldwide.espacenet.com (Year: 2014).*

Mochizuki; Masatoshi, "Iron Removing Apparatus with Cooling Function" (English Translation), Feb. 9, 2006, worldwide.espacenet.com (Year: 2006).*

Onishi; Kenji, "Iron Removing Equipment with Cleaning Function" (English Translation), May 27, 2004, worldwide.espacenet.com (Year: 2004).*

* cited by examiner

TEMPERATURE-CONTROLLED TRAMP METAL SEPARATION ASSEMBLY

BACKGROUND OF THE INVENTION

1. Field of the Invention

The present invention relates to devices for removing tramp metals from a stream of raw materials, and more particularly to a tramp metal separation assembly that can automatically control and adjust the operating temperature thereof.

2. Description of the Related Art

A typical prior art device for removing tramp metals from a stream of raw materials is disclosed in U.S. Pat. No. 8,132,674. This tramp metal separation device, in brief, uses a number of actuators for moving a magnet assembly in and out of a housing provided with a wiper plate so that the device can remove continuously the tramp metals captured on the magnet assembly. A primary disadvantage of this device is that the continuous friction between the magnet assembly and the wiper plate will increase the operating temperature of the magnet assembly such that the magnetic force of the magnet assembly will be significantly reduced.

A prior art magnetic separator for removing tramp metals from a stream of raw materials is disclosed in Chinese Utility Model Pat. 204,602,393. The magnetic separator includes a plurality of magnetic sets mounted on a frame. Each magnetic set is composed of a magnetic rod and two shafts connected respectively to each end of the magnetic rod. The magnetic separator further includes a sleeve tube sleeved outside the magnetic rod in a way that the sleeve tube is moveable between the magnetic rod and the shaft for capturing and discharging the tramp metals of raw materials. Since the sleeve tube of the magnetic separator moves back and forth on the surface of the magnetic rod and the shaft, the operating temperature of the magnetic separator will also increase due to friction, resulting in a decrease in the magnetic force of each magnetic rod.

Thus, it is need to configure a tramp metal separation assembly while the tramp metal separating process is operated efficiently, automatically and continuously, the operating temperature can be maintained at an acceptable level.

SUMMARY OF THE INVENTION

The present invention overcomes the disadvantages in the related art in a temperature-controlled tramp metal separation assembly comprising a core rod and a magnetic set. The core rod is made of non-magnetic materials and includes a longitudinal axis, a chamber, a first end with at least an air inlet, a second end with at least an air outlet. The magnetic set includes a plurality of magnetic members and a plurality of spacers made of a material having a high magnetic permeability or a high saturation magnetization. Each of the spacers is disposed between the two adjacent magnetic members. The magnetic set is nested in the chamber along the longitudinal axis in way that an air path is formed therein so that an external cooling air flow can be introduced from the air inlet, and then discharged from the air outlet via the air path. Thus, the present invention provides the advantage of the operating temperature of the tramp metal separating process being maintained at an acceptable level, preventing the magnetic force of the magnet set from being reduced.

In a preferred embodiment, the chamber of the core rod has a first part and a second part. The magnetic set is nested in the second part to form a magnetic section. The first part forms a non-magnetic section.

The present invention also provides for the temperature-controlled tramp metal separation assembly further comprising a sleeve tube made of non-magnetic materials and having a length less than that of the core rod. The sleeve tube is sleeved outside the core rod in a way that it is moveable to and fro along the longitudinal axis of the core rod and between a first position, wherein the sleeve tube corresponds to the magnetic section to capture tramp metals of the raw materials, and a second position, wherein the sleeve tube corresponds to the non-magnetic section to discharge tramp metals captured thereon.

In another preferred embodiment, the temperature-controlled tramp metal separation assembly further comprises a housing and a cooling air transmitting unit. The housing includes a first discharging area, a second discharging area and a feeding area between the first discharging area and the second discharging area. The sleeve tube includes a first portion, a second portion, a longitudinal length less than the longitudinal length of the core rod and an axial hole with an inner diameter larger than the outer diameter of the core rod. The chamber of the core rod has a first part, a second part and a third part. The first part forms a first non-magnetic section, the second part forms a magnetic section by nesting the magnetic set, and the third part forms a second non-magnetic section. The core rod is mounted on the housing in a way that the first and second non-magnetic sections correspond respectively to the first and second discharging areas and the magnetic section corresponds to the feeding area. The cooling air transmitting unit is coupled with the core rod in a way that an external cooling air flow is to introduced from the air inlet, and then discharged from the air outlet via the air path.

In a further preferred embodiment, the housing includes a front wall, a rear wall, a first side wall, a second side wall, a first inner plate and a second inner plate. The front and rear walls combine with the first and second side walls to define a receiving space within the housing. The first inner plate and the second inner plate are respectively disposed between the first side wall and the second side wall to divide the space into the first discharging area, the second discharging area and the feeding area. The core rod is adapted to pass through the first inner plate and the second inner plate and secures respectively each of ends thereof on the front and rear walls. The sleeve tube is also adapted to pass through the first inner plate and the second inner plate in a way that it is moveable to and fro between the first and second positions. The temperature-controlled tramp metal separation assembly further comprises a temperature sensor mounted on a part of the first side wall located in the feeding area of the housing and coupled with the cooling air transmitting unit in a way that when the operating temperature of the housing is equal to or greater than a first predetermined temperature, the temperature sensor will produce a first signal to actuate the air introducing device for introducing external air into the air path, and when the operating temperature of the housing is equal to or lower than a second predetermined temperature, the temperature sensor will produce a second signal to stop the air introducing device from introducing external air to the air path.

In a further preferred embodiment, the temperature-controlled tramp metal separation assembly further comprises a plurality of the core rods and a plurality of the sleeve tubes. The core rods and the sleeve tubes are divided into a plurality of groups. Each of the groups is arranged in a way that each of the core rods and the sleeve tubes thereof is parallel to each other in a horizontal plane. Each of the horizontal planes is spaced apart such that the core rods and the sleeve tubes are provided in a staggered configuration to ensure contact of the raw materials with the first and second portions of the sleeve tubes. The cooling air transmitting unit includes an air input member connected with external cooling air suppliers, an air diverter having a plurality of output ends connected respectively to the air inlet of each of the core rods, and a controlling member operatively connected to the air input member and the air diverter respectively.

In a further preferred embodiment, the temperature-controlled tramp metal separation assembly further comprises a first driving plate, a second driving plate and a linear actuator. The first driving plate is fixedly connected to a first end of each of the sleeve tubes and disposed in the first discharging area. The second driving plate is fixedly connected to a second end of each of the sleeve tubes and disposed in the second discharging area. Each of the driving plates is configured to be moveable along the core rod. And the linear actuator is connected with one of the driving plates for actuating the sleeve tubes to move back and forth between the first position and the second position.

BRIEF DESCRIPTION OF THE DRAWINGS

The above, as well as other advantages of the present invention will become readily apparent to those skilled in the art from the following detailed description when considered in the light of the accompanying drawings in which.

DETAILED DESCRIPTION OF THE INVENTION

Figure 1:
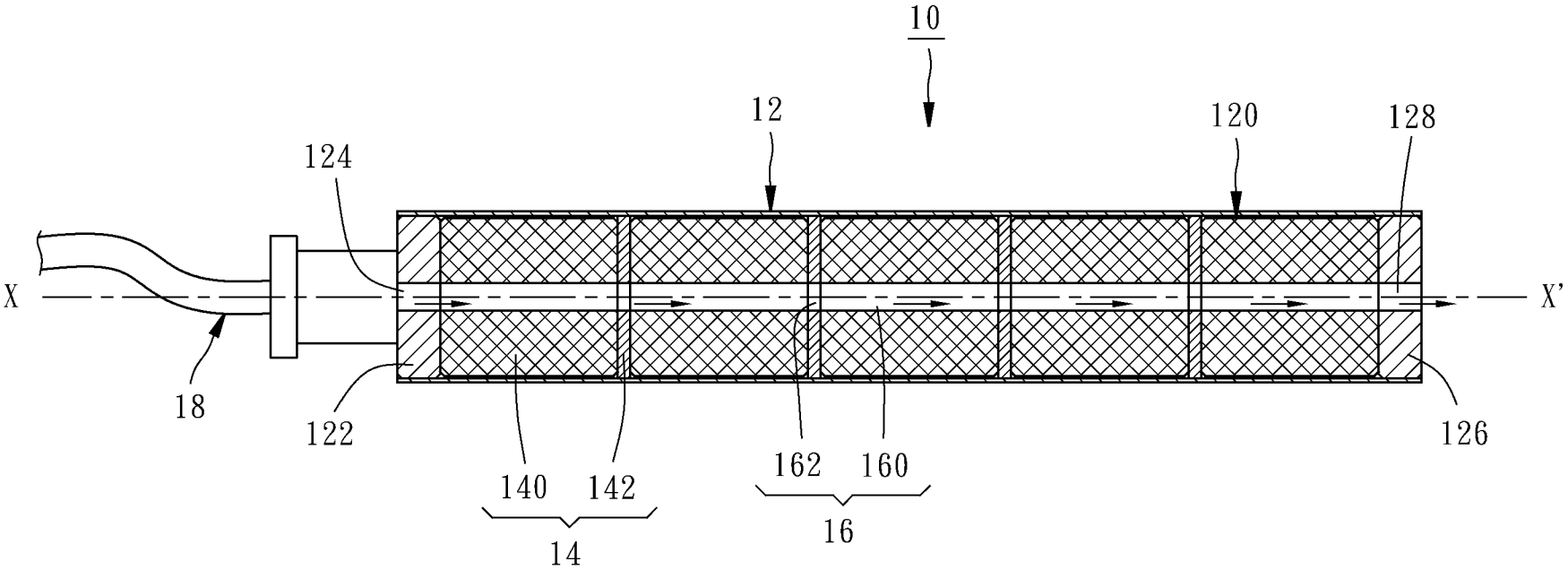
FIG. 1 is a longitudinal sectional view of a temperature-controlled tramp metal separation assembly according to a first preferred embodiment of the present invention.

Referring firstly to FIG. 1, it shows a temperature-controlled tramp metal separation assembly 10 configured according to a first preferred embodiment of the present invention. The temperature-controlled tramp metal separation assembly 10 generally includes a core rod 12 and a magnetic set 14. The core rod 12 is made of non-magnetic materials, such as stainless steel, titanium alloy, copper alloy or aluminum alloy, etc. The core rod 12 includes a longitudinal axis X-X', a chamber 120, a first closed end 122 with at least an air inlet 124, a second closed end 126 with at least an air outlet 128. The magnetic set 14 includes a plurality of magnetic members 140 and a plurality of spacers 142. In this embodiment, the magnetic set 14 has five magnetic members 140 made of NdFeB magnets and four spacers 142 made of high magnetic permeability or high saturation magnetization materials such as pure iron, low carbon steel or iron-cobalt alloy. Each of the spacers 142 is respectively disposed between the two adjacent magnetic members 140.

The magnetic set 14 is nested in the chamber 120 along the longitudinal axis X-X' in way that an air path 16 is formed therein. In this embodiment, each of the magnetic members 140 includes a first bore 160 and each of the spacers 142 includes a second bore 162 coaxial with the first bore 160 so that a part of the air path 16 is formed thereby. In this way, as shown in the direction of the arrow in FIG. 1, an external cooling air flow is introduced by a cooling air transmitting unit 18 from the air inlet 124, then passes through the air path 16, and finally is discharged from the air outlet 128 so that, during operation, the operating temperature of the temperature-controlled tramp metal separation assembly 10 can be reduced.

Figure 2:
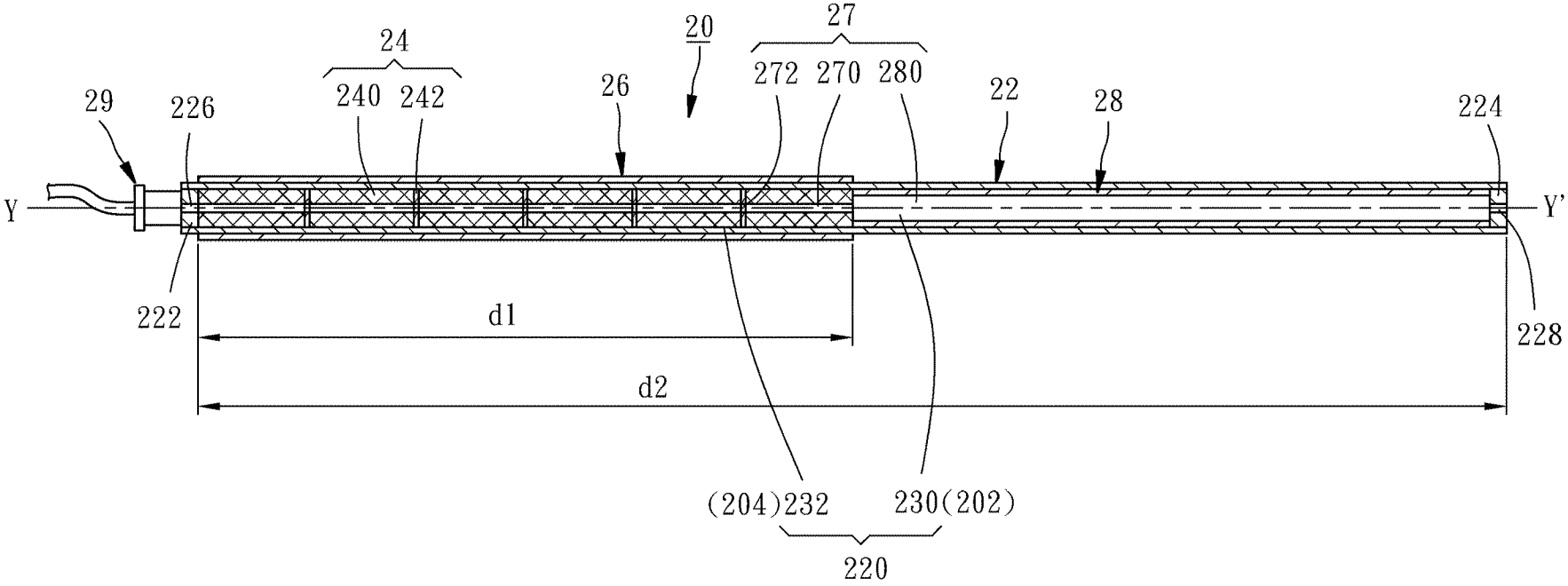
FIG. 2 is a longitudinal sectional view of a temperature-controlled tramp metal separation assembly according to a second preferred embodiment of the present invention.

Next, referring to FIG. 2, it shows a temperature-controlled tramp metal separation assembly 20 configured according to a second preferred embodiment of the present invention. The temperature-controlled tramp metal separation assembly 20 includes a core rod 22, a magnetic set 24, a sleeve tube 26 and a non-magnetic inner tube 28. The core rod 22 is also made of non-magnetic materials and includes a longitudinal axis Y-Y', a chamber 220, a first closed end 222 with at least an air inlet 226, a second closed end 224 with at least an air outlet 228. The chamber 220 has a first part 230 and a second part 232. The magnetic set 24 also includes a plurality of magnetic members 240 and a plurality of spacers 242. Each of the spacers 242 is respectively disposed between the two adjacent magnetic members 240. The first part 230 of the chamber 220 is adapted to be a non-magnetic section 202. The second part 232 of the chamber 220 is adapted to be a magnetic section 204 by nesting the magnetic set 24 therein. Each of the magnetic members 240 includes a first through hole 270 and each of the spacers 242 includes a second through hole 272 coaxial with the first through hole 270. The sleeve tube 26 is also made of non-magnetic materials and has a length d1 less than the length d2 of the core rod 22. In this embodiment, d1 is about one-half of d2. The sleeve tube 26 is sleeved outside the core rod 22 in a way that it is moveable to and fro along the longitudinal axis Y-Y' of the core rod 22 and between a first position, wherein the sleeve tube 26 corresponds to the magnetic section 204 to capture tramp metals of the raw materials, and a second position, wherein the sleeve tube 26 corresponds to the non-magnetic section 202 to discharge tramp metals captured thereon. The non-magnetic inner tube 28 is disposed within the first part 230 of the chamber 220 and abuts against one end of the magnetic set 24 so that the strength of the core rod 22 can be reinforced and the magnetic set 24 can be firmly arranged in the second part 232 of the chamber 220. In addition, the temperature-controlled tramp metal separation assembly 20 further includes an air path 27 composed of the first through hole 270, the second through hole 272 and a hollow interior 280 of the non-magnetic inner tube 28. In this way, an external cooling air flow similarly is introduced by a cooling air transmitting unit 29 from the air inlet 226, then passes through the air path 27, and finally is discharged from the air outlet 228 so that, during operation, the operating temperature of the temperature-controlled tramp metal separation assembly 20 can be reduced.

Referring now to FIGS. 3-11, it shows a temperature-controlled tramp metal separation assembly 30 configured according to a third preferred embodiment of the present invention. The temperature-controlled tramp metal separation assembly 30 comprises a housing 40, a plurality of core rods 60, a plurality of magnetic sets 70, a plurality of sleeve tubes 90, a control means 200, a cooling air transmitting unit 300, a temperature sensor 400 and a pair of linear actuators 500.

The housing 40 comprises a front wall 42, a rear wall 44, a first side wall 46 and a second side wall 48. The front and rear walls 42, 44 combine with the first and second side walls 46, 48 to define a generally elongate receiving space 50 within the housing 40. The housing 40 further comprises a first inner plate 52 and a second inner plate 54. The first inner plate 52 and the second inner plate 54 are respectively disposed between the first side wall 46 and the second side wall 48 to divide the space 50 into a first discharging area 57, a second discharging area 58 and a feeding area 56 between the first discharging area 57 and the second discharging area 58. The feeding area 56 has a feeding inlet 560 into which a raw material containing tramp metals is introduced and a feeding outlet 562 from which the raw material is discharged. The first and second discharging areas 57, 58 respectively have a first discharging outlet 570 and a second discharging outlet 580 disposed in the bottom side thereof.

Figure 5:
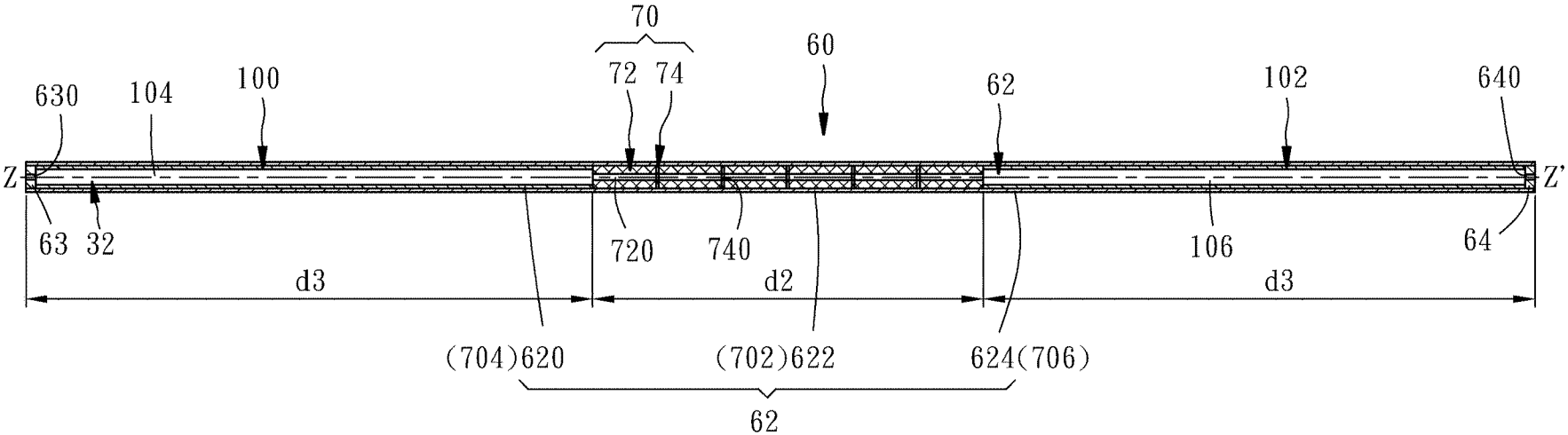
FIG. 5 is a longitudinal sectional view of a core rod of the embodiment of the present invention shown in FIG. 3.

The core rod 60, as shown in FIG. 5, is also made of non-magnetic materials and includes a first longitudinal axis Z-Z', an axial extending chamber 62, a first closed end 63 with an air inlet 630 and a second closed end 64 with an air outlet 640. The chamber 62 sequentially divides into a first part 620, a second part 622 and a third part 624. In this embodiment, each part has approximately the same length. The second part 622 forms a magnetic section 702 by being filled with the magnetic set 70. The first part 620 and the third part 624 respectively form a first non-magnetic section 704 and a second non-magnetic section 706. Each of the magnetic sets 70, in this embodiment, includes five magnetic members 72 made of NdFeB magnets, and four spacers 74 made of high magnetic permeability or high saturation magnetization materials such as pure iron, low carbon steel or iron-cobalt alloy. Each of the spacers 74 is respectively disposed between the two adjacent magnetic members 72. Each of the magnetic members 72 includes a third through hole 720 and each of the spacers 74 includes a fourth through hole 740 coaxial with the third through hole 720.

The temperature-controlled tramp metal separation assembly 30 further comprises a first non-magnetic inner tube 100 and a second non-magnetic inner tube 102. The first non-magnetic inner tube 100 is disposed within the first part 620 of the chamber 62 and abuts against a first side of the magnetic set 70, and the second non-magnetic inner tube 102 is disposed within the third part 624 of the chamber 62 and abuts against a second side of the magnetic set 70. The first and second non-magnetic inner tubes 100, 102 are not only used to reinforce the strength of the core rod 60, but also used to abut on both sides of the magnetic set 70 so that the magnetic set 70 can be firmly arranged in the second part 622 of the chamber interior 62.

Figure 6:
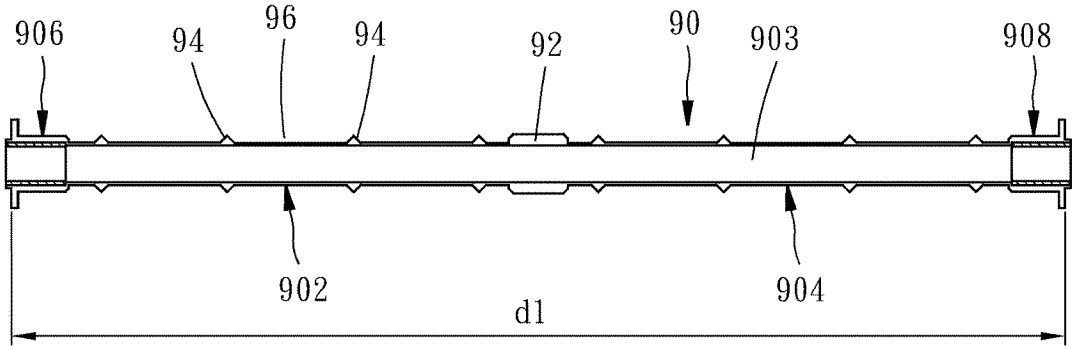
FIG. 6 is a longitudinal sectional view of a sleeve tube of the embodiment of the present invention shown in FIG. 3.
Figure 7:
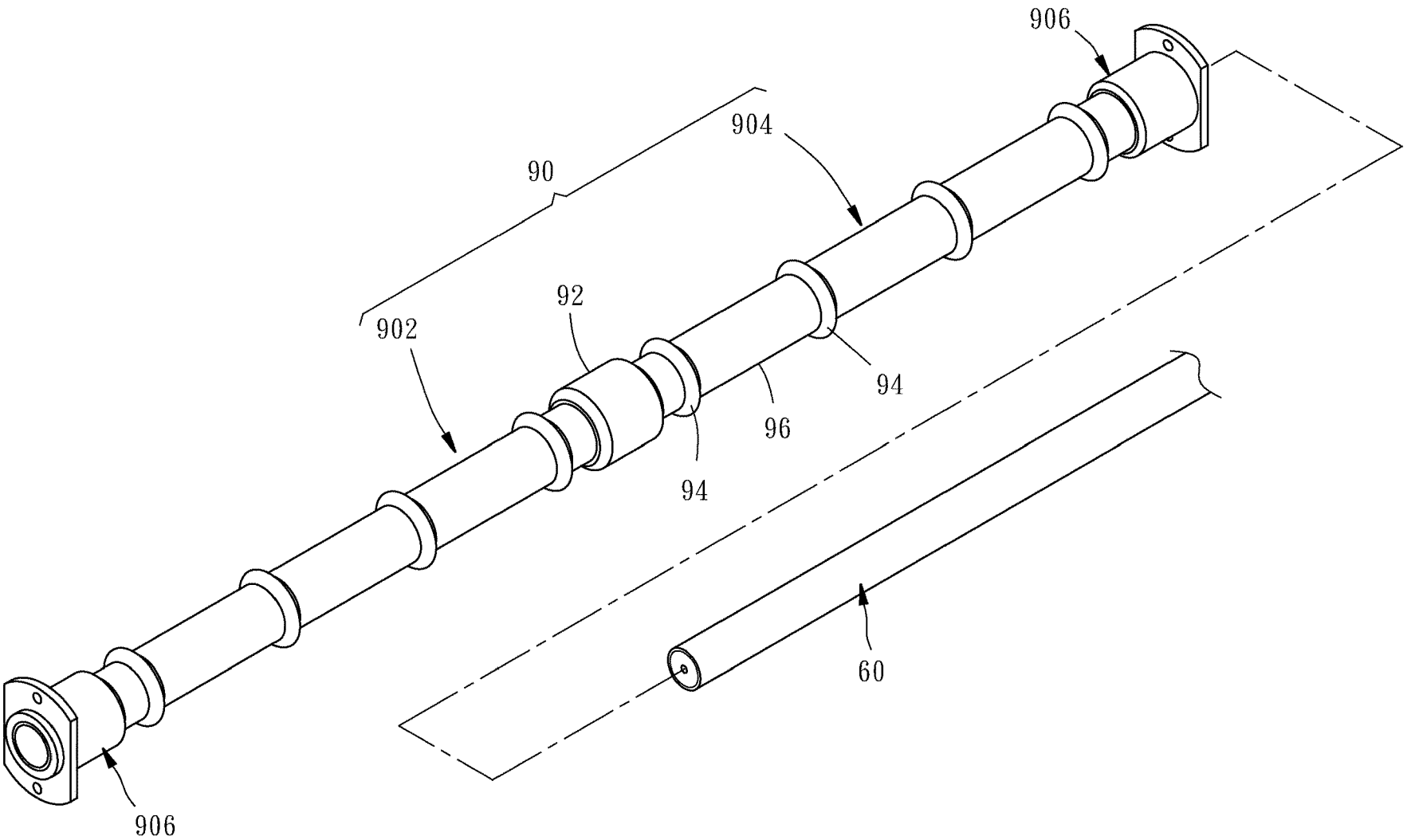
FIG. 7 is an exploded view of the core rod and the sleeve tube of the embodiment of the present invention shown in FIG. 3, showing that the sleeve tube is sleeved outside the core rod.

The sleeve tube 90, as shown in FIG. 6, is also made of non-magnetic materials and includes a first portion 902, a second portion 904, a longitudinal length d1, and an axial hole 903 with an inner diameter larger than the outer diameter of the core rod 60. The first portion 902 has the same length as the second portion 904. The longitudinal length d1 of the sleeve tube 90 is approximately equal to the sum of the length d2 of the magnetic section 702 and the length d3 of the first non-magnetic section 704 or the second non-magnetic section 706.

In this embodiment, the temperature-controlled tramp metal separation assembly 30 further includes an air path 32 composed of a first hollow interior 104 of the first non-magnetic inner tube 100 which is a first portion of the air path 32, the third through hole 720 and the fourth through hole 740 of the magnetic set 70 which are a second portion of the air path 32 and a second hollow interior 106 of the second non-magnetic inner tube 102 which is a third portion of the air path 32. In this way, an external cooling air flow can be introduced by the cooling air transmitting unit 300 from the air inlet 630, then passes through the air path 32, and finally is discharged from the air outlet 640 so that, during operation, the operating temperature of the temperature-controlled tramp metal separation assembly 30 can be reduced.

As shown in FIGS. 8-11, in this embodiment, the first inner plate 52 has a plurality of first bores 520 and the second inner plate 54 has a plurality of second bores 540. The first bores 520 and the second bores 540 are coaxial and have the same diameter. In combination, the core rod 60 passes through the first bore 520 and the second bore 540 and secures each of the closed ends 63, 64 thereof on each of the front and rear walls 42, 44 of the housing 40 in a way that the first non-magnetic section 704 and the second non-magnetic section 706 correspond respectively to the first and second discharging area 57, 58, and the magnetic section 702 corresponds to the feeding area 56. In this embodiment, each of the closed ends 63, 64 is respectively secured on the front and rear walls 42, 44 by bolts (not shown in the drawings).

Figure 9:
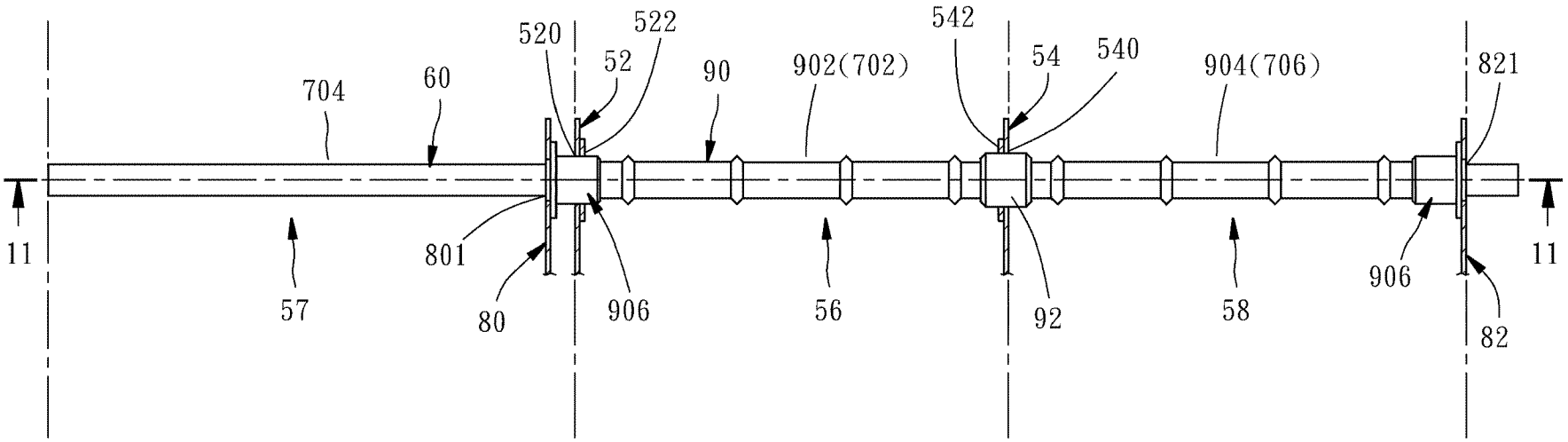
FIG. 9 is a lateral side view showing a part of FIG. 8, where the sleeve tube is in a first position.
Figure 10:
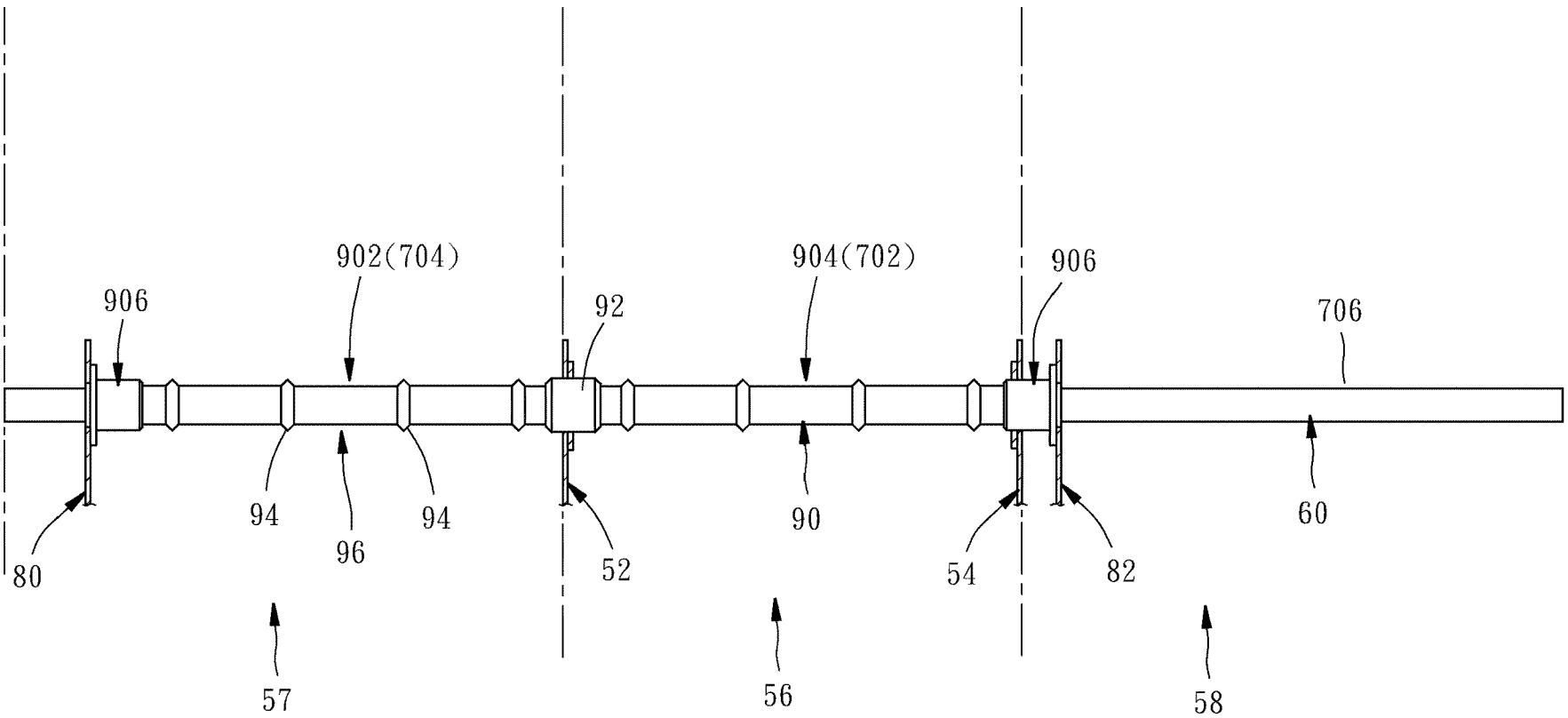
FIG. 10 is a lateral side view showing a part of FIG. 8, where the sleeve tube is in a second position.
Figure 11:
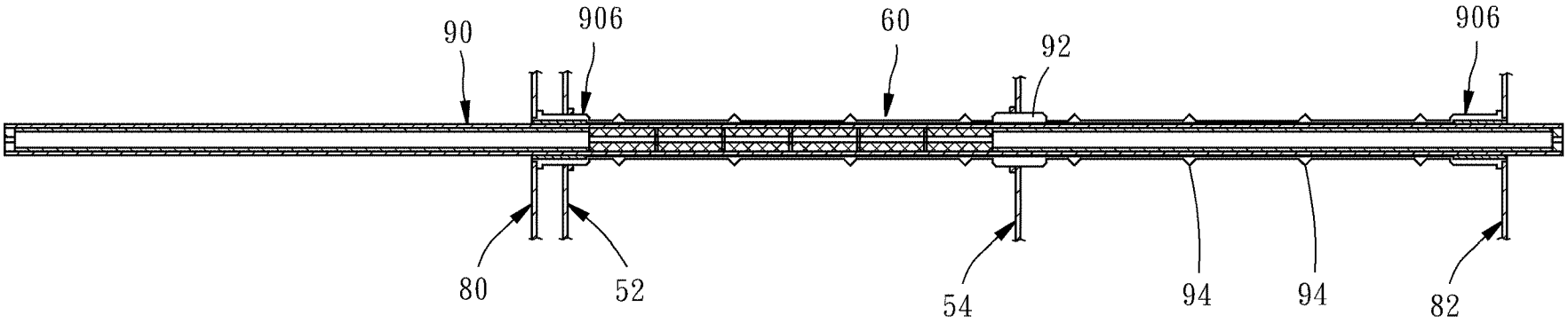
FIG. 11 is a longitudinal sectional view taken along the direction 11-11 of FIG. 9.

The sleeve tube 90 is sleeved outside the core rod 60 by the axial hole 903 thereof and also extends through the first bore 520 and the second bore 540 in a way that it is moveable along the first longitudinal axis Z-Z' of the core rod 60 and between a first position, as shown in FIG. 9, wherein the first portion 902 corresponds to the magnetic section 702 and the second portion 904 corresponds to the second non-magnetic section 706, and a second position, as shown in FIG. 10, wherein the first portion 902 corresponds to the first non-magnetic section 704 and the second portion 904 corresponds to the magnetic section 702. In this embodiment, the periphery of the first bore 520 and the second bore 540 respectively are disposed a first bushing 522, 542 thereon so that the sleeve tube 90 can move smoothly between the first position and the second position.

In addition, in this embodiment, as shown in FIG. 6, the sleeve tube 90 includes a convex ring 92 disposed between the first portion 902 and the second portion 904 and a plurality of flanges 94 for dividing the surface of the sleeve tube 90 into a plurality of receiving regions 96. The width and the outer diameter of each of the flanges 94 are less than that of the convex ring 92 so that when the first portion 902 or the second portion 904 of the sleeve tube 90 corresponds to the magnetic section 702 of the core rod 60, each of the receiving regions 96 can evenly capture tramp metals, and during reciprocating movement, the tramp metals captured thereon will not be scraped off by the inner plates 52, 54.

Furthermore, each end of the sleeve tube 90 is respectively sleeved with a second bushing 906, 908 for maintaining the core rod 60 located at the center of the axial hole 903 and reducing the friction between the sleeve tube 90 and the core rod 60.

Figure 3:
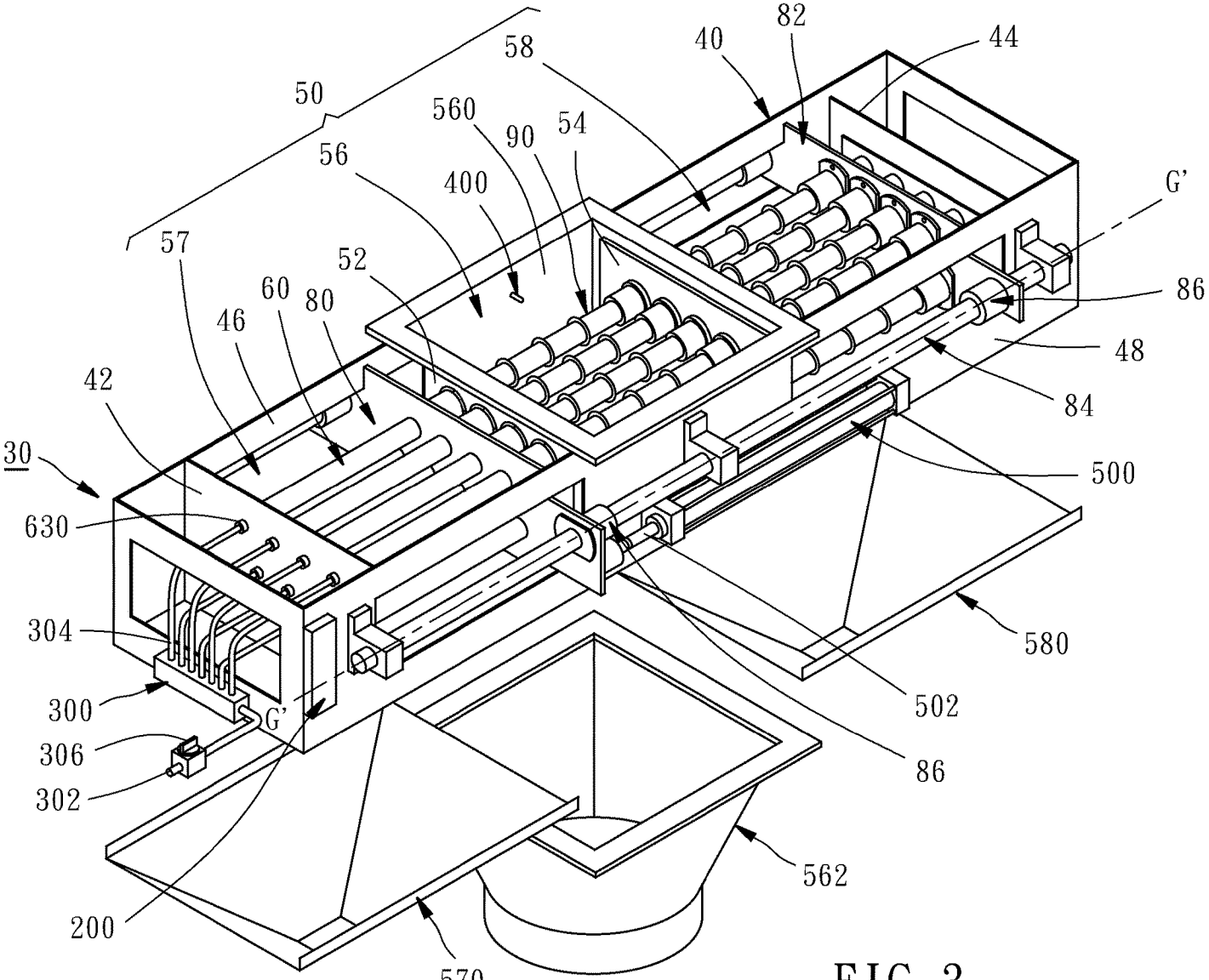
FIG. 3 is a perspective view of a temperature-controlled tramp metal separation assembly according to a third preferred embodiment of the present invention.
Figure 4:
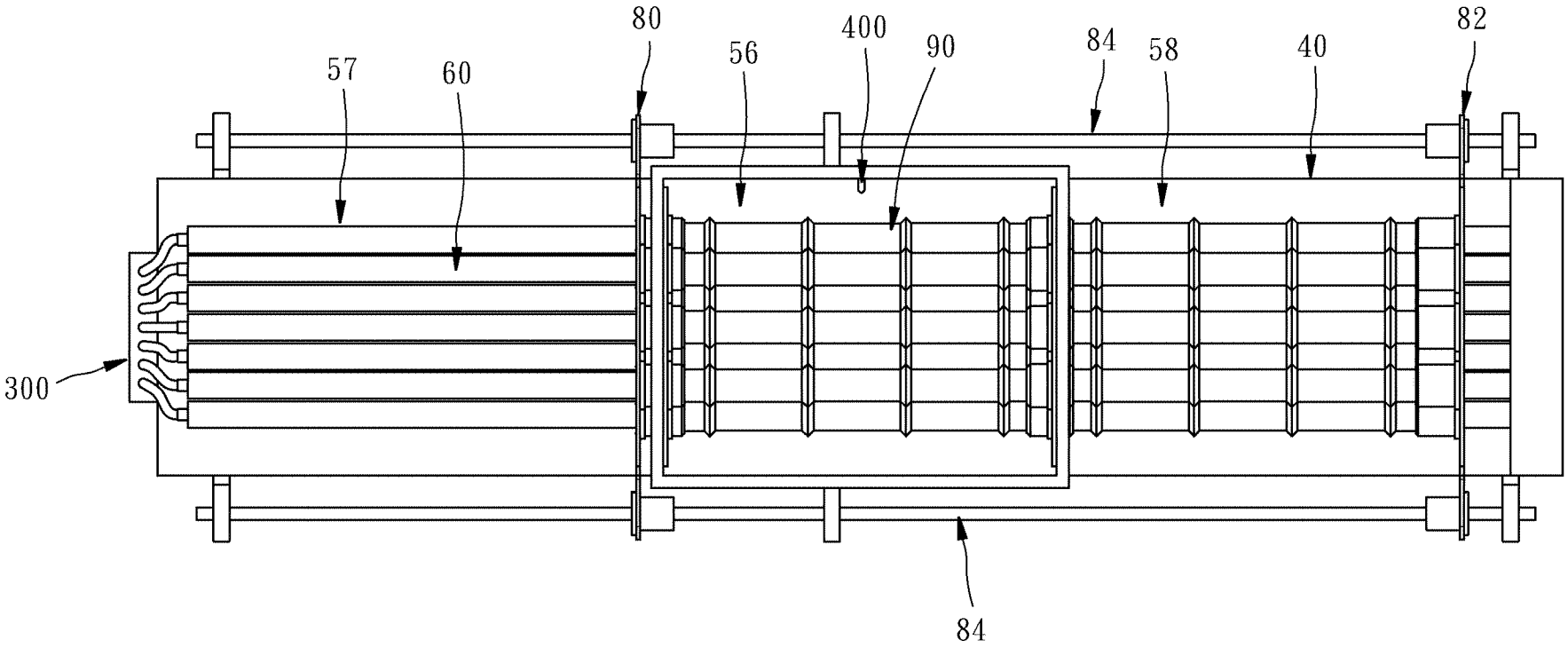
FIG. 4 is a top side view of the embodiment of the present invention shown in FIG. 3.
Figure 8:
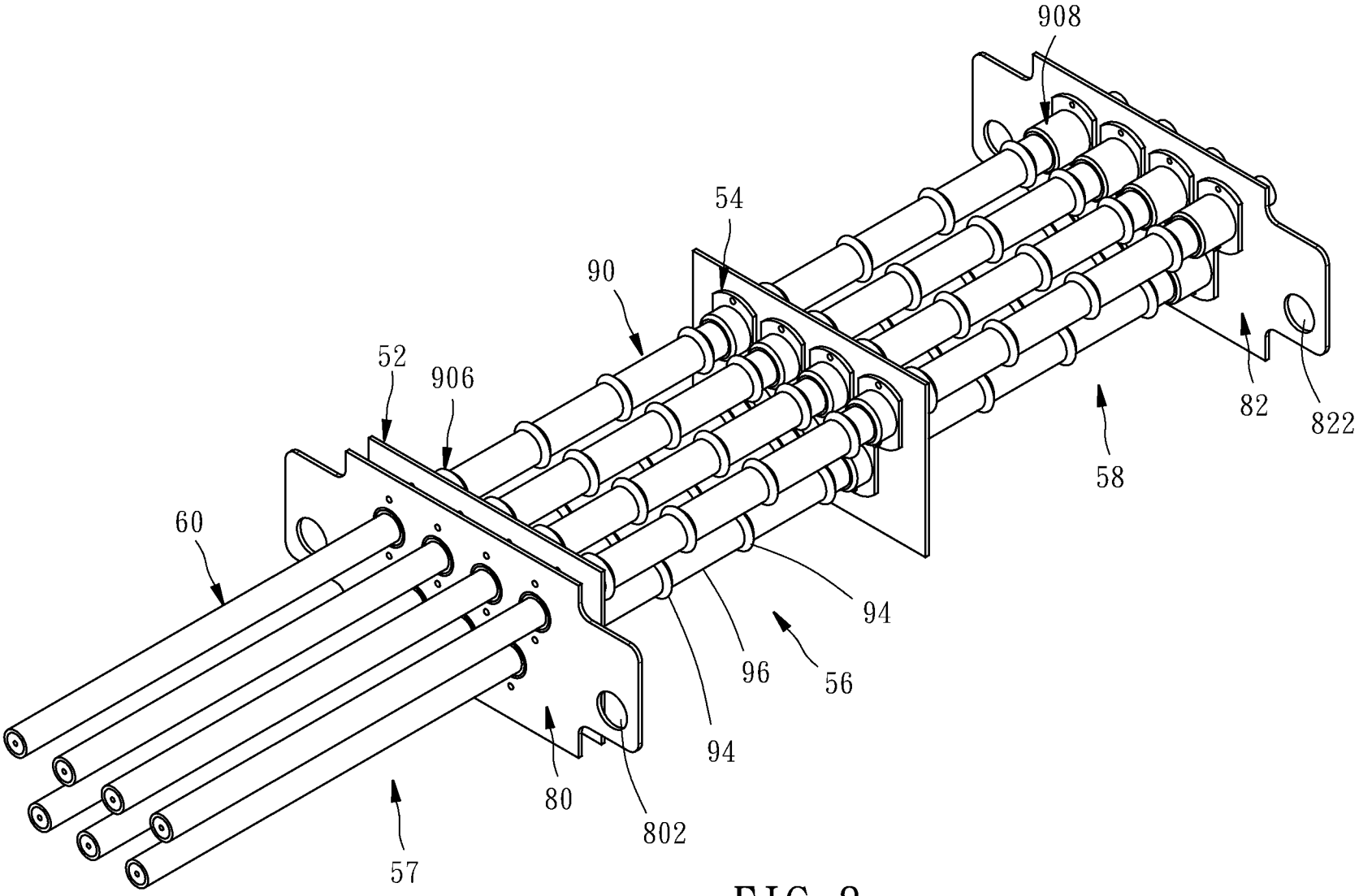
FIG. 8 is a perspective view in partial portion of the embodiment of the present invention shown in FIG. 3.

In this embodiment, as shown in FIGS. 3, 4 and 8, the temperature-controlled tramp metal separation assembly 30 includes seven core rods 60, which are divided into a first group and a second group. The first group has four core rods 60 being secured between the front and rear walls 42, 44 in a way that the four core rods 60 are parallel to each other and in a first horizontal plane. The second group has three core rods 60 being also secured between the front and rear walls 42, 24 in a way that the three core rods 60 are parallel to each other and in a second plane horizontal spaced apart the first horizontal plane. All of the core rods 60 are provided in a staggered configuration to ensure contact of the raw materials with the magnetic section 702 of each of the core rods 60. The tramp metal separation assembly 30 also includes seven sleeve tubes 90, each of which is combined with each of the core rods 60 respectively as the way mentioned above. When each of the sleeve tubes 90 is located at the first position, as shown in FIG. 9, the first portion 902 corresponds to the feeding area 56 such that each of the receiving regions 96 will capture the tramp metals of the raw materials, and the second portion 904 corresponds to the second discharging area 58 such that the tramp metals captured on each of the receiving regions 96 will automatically leave therefrom and fall to the second discharging outlet 580. When each of the sleeve tubes 90 is located at the second position, as shown in FIG. 10, the second portion 904 corresponds to the feeding area 56 such that each of the receiving regions 96 thereof will capture the tramp metals of the raw materials, and the first portion 902 corresponds to the first discharging area 57 such that the tramp metals captured on each of the receiving regions 96 will automatically leave therefrom and fall to the first discharging outlet 570. Thereby, when the sleeve tubes 90 reciprocally move between the first and second positions, the tramp metal separation assembly 30 can automatically and continuously remove the tramp metals from the raw materials.

In this embodiment, the tramp metal separation assembly 30 may further comprise a first driving plate 80 fixedly connected to the first end of each of the sleeve tubes 90 and disposed in the first discharging area 57. The first driving plate 80 has a plurality of third bores 801 for being passed through by the core rods 60, and a second driving plate 82 fixedly connected to the second end of each of the sleeve tubes 90 and disposed in the second discharging area 58, wherein the second driving plate 82 has a plurality of fourth bores 821 for being passed through by the core rods 60.

In this embodiment, as shown in FIGS. 3 and 4, the cooling air transmitting unit 300 includes an air introducing member 302, an air diverter 304 and a controlling member 306. The air introducing member 302 is connected with an external cooling air supplier (not shown in the figures). The air diverter 304 has a plurality of output ends connected respectively to the air inlet 630 of each of the core rods 60 for introducing external air into the air path 32. The controlling member 306 is operatively connected to the air introducing member 302 and the air diverter 304 respectively to control the amount and period of the external cooling air introduced. The temperature sensor 400 may be a temperature probe or other similar component which is mounted on a part of one of the side walls 46, 48 located in the feeding area 56 of the housing 40 and coupled with the cooling air transmitting unit 300 in a way that when the operating temperature of the housing 40 is equal to or greater than a first predetermined temperature, the temperature sensor 400 will produce a first signal to actuate the cooling air transmitting unit 300 for introducing external cooling air flow into the air path 32, and when the operating temperature of the housing is equal to or lower than a second predetermined temperature, the temperature sensor 400 will produce a second signal to stop the cooling air transmitting unit 300 from introducing external cooling air flow to the air path 32. The first and second predetermined temperatures are set according to the materials of magnetic members 72. For example, when each of the magnetic members 72 is made of NdFeB magnets, the first predetermined temperature may be set between 40° C. and 110° C., and the second predetermined temperature may be relatively set between 30° C. and 100° C. And when the first predetermined temperature is set at 40° C., the second predetermined temperature is relatively set at 30° C.

In this embodiment, each of the linear actuators 500 is respectively disposed on the housing 40 and connected with one of the driving plates 80, 82 or both for actuating the sleeve tubes 90 to move back and forth between the first position and the second position. In this embodiment, each of the linear actuators 500 may be a pneumatic linear actuator that is controlled by a solenoid-operated pneumatic valve assembly, as is well known in the art. Each of the pneumatic linear actuators 500 has a piston 502 coupled to one of the driving plates 80, 82 so that all of the sleeve tubes 90 can be actuated at the same time to move reciprocally between the first and second positions.

In this embodiment, the tramp metal separation assembly 30 further comprises a pair of guiding rods 84 disposed respectively on each of the side walls 46, 48 of the housing 40. Each of the guiding rods 84 has a second longitudinal axis G-G' parallel to the first longitudinal axis Z-Z' of the core rod 60 and passes through a first guiding openings 802 disposed on the first driving plate 80 and a second guiding openings 822 disposed on the second driving plate 82 for guiding the back and forth movement the first and second driving plates 80, 82. The periphery of each of the first and second guiding openings 802, 822 is disposed with a third bushing 86 so that the first and second driving plates 80, 82 can move smoothly on each of the guiding rods 84.

Figure 12:
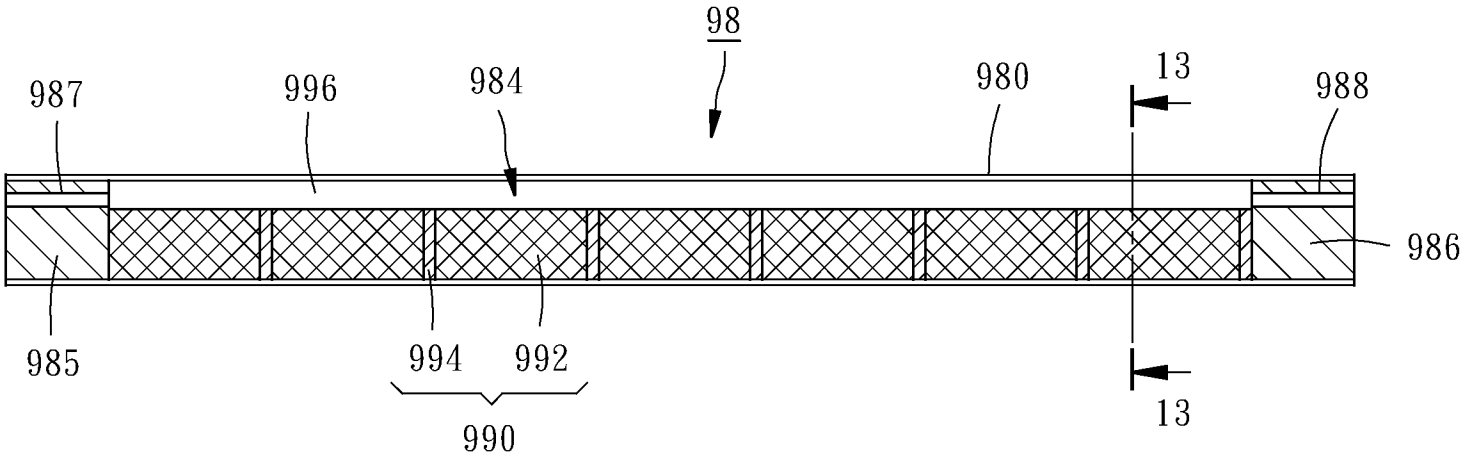
FIG. 12 is a longitudinal sectional view of a temperature-controlled tramp metal separation assembly according to a fourth preferred embodiment of the present invention.
Figure 13:
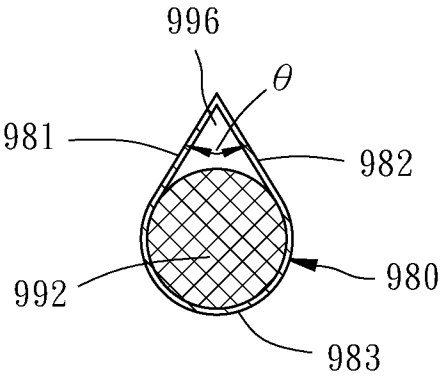
FIG. 13 is a cross-sectional view taken along the direction 13-13 of FIG. 12.

Furthermore, referring to FIGS. 12 and 13, it shows a temperature-controlled tramp metal separation assembly 98 configured according to a fourth preferred embodiment of the present invention. The temperature-controlled tramp metal separation assembly 98 similarly comprises a core rod 980 and a magnetic set 990. The core rod 980 is also made of non-magnetic materials and includes a first flat surface 981, a second flat surface 982, an arc-shaped surface 983, a chamber 984, a first closed end 985 with at least an air inlet 987, a second closed end 986 with at least an air outlet 988. The first flat surface 981 combines with the second flat surface 982 to form an upper portion of the chamber 984 with an included angle θ less than 90 degrees. The arc-shaped surface 983 combines with the first flat surface 981 and second flat surface 982 to form an arc-shaped lower portion of the chamber 984. In this embodiment, the included angle θ is 63 degrees so that the chamber 984 can be raindrop-shaped. The magnetic set 990 also include a plurality of magnetic members 992, and a plurality of spacers 994 made of a material having a high magnetic permeability or a high saturation magnetization. Each of the magnetic members 992 and each of the spacers 994 have a circular-shaped cross section and are nested in the lower portion of the chamber 984 in a way that a part of the upper portion of the chamber 984 forms an air path 996 so that an external cooling air flow can be introduced from the air inlet 987, and then discharged from the air outlet 988 via the air path 996.

What is claimed is:

1. A temperature-controlled tramp metal separation assembly comprising:

a housing including a front wall, a rear wall, a first side wall, a second side wall, a first inner plate and a second inner plate, the front and rear walls combining with the first and second side walls to define a receiving space within the housing, the first inner plate and the second inner plate being respectively disposed between the first side wall and the second side wall to divide the receiving space into a first discharging area, a second discharging area and a feeding area;

a plurality of core rods, each of the core rods made of non-magnetic materials and including a first longitudinal axis, a chamber, a first closed end with at least an air inlet, a closed second end with at least an air outlet;

a plurality of magnetic sets, each magnetic set including a plurality of magnetic members and a plurality of spacers made of a material having a high magnetic permeability or a high saturation magnetization and respectively disposed between two adjacent magnetic members;

the chamber of the core rod having a first part, a second part, a third part and an air path, the first part forming a first non-magnetic section and a first portion of the air path, the second part forming a magnetic section by nesting one of the magnetic sets therein along the longitudinal axis in a way that a second portion of the air path is formed, and the third part forming a second non-magnetic section and a third portion of the air path;

the first inner plate having a plurality of first bores and the second inner plate having a plurality of second bores;

each of the core rods passing through each of the first bores of the first inner plate, each of the second bores of the second inner plate and securing respectively each of ends thereof on the front and rear walls in a way that the first and second non-magnetic sections correspond respectively to the first and second discharging areas and the magnetic section corresponds to the feeding area;

a plurality of sleeve tubes, each of the sleeve tubes made of non-magnetic materials and including a first portion, a second portion, a longitudinal length less than the longitudinal length of the core rod and an axial hole with an inner diameter larger than the outer diameter of the core rod so that the sleeve tube can be sleeved outside the core rod in a way that the sleeve tube passes through the first bore of the first inner plate and the second bore of the second inner plate to be moveable to and fro along the longitudinal axis of the core rod and between a first position, wherein the first portion corresponds to the magnetic section to capture tramp metals of raw materials and the second portion corresponds to the second non-magnetic section to discharge tramp metals captured thereon, and a second position, wherein the first portion corresponds to the first non-magnetic section to discharge tramp metals captured thereon, and the second portion corresponds to the magnetic section to capture tramp metals of raw materials;

a cooling air transmitting unit coupled with each of the core rods to introduce an external cooling air flow from the air inlet, and then discharged from the air outlet via the air path;

a first driving plate fixedly connected to a first end of each of the sleeve tubes and disposed in the first discharging area, the first driving plate having a plurality of third bores for being passed through by the core rods;

a second driving plate fixedly connected to a second end of each of the sleeve tubes and disposed in the second discharging area, the second driving plate also having a plurality of fourth bores for being passed through by the core rods;

a pair of guiding rods disposed respectively on each of the side walls of the housing, each of the guiding rods having a second longitudinal axis parallel to the first longitudinal axis of the core rod;

the first driving plate further having a pair of first guiding openings passed through by each of the guiding rods, the second driving plate further having a pair of second guiding openings passed through by each of the guiding rods; and a linear actuator connected with the first or the second driving plates for actuating the sleeve tubes to move back and forth along the core rods between the first position and the second position.

2. The temperature-controlled tramp metal separation assembly of claim 1, wherein each of the magnetic members includes a first through hole and each of the spacers includes a second through hole coaxial with the first through hole such that a part of the air path is formed by the first and second through holes.

3. The temperature-controlled tramp metal separation assembly of claim 1, wherein each of the core rods includes a first flat surface, a second flat surface and an arc-shaped surface, the first flat surface and the second flat surface are combined to form an upper portion of the chamber with an included angle less than 90 degrees, the arc-shaped surface are combined with the first flat surface and the second flat surface to form an arc-shaped lower portion of the chamber, each of the magnetic members and each of the spacers have a circular-shaped cross section and are nested in the lower portion of the chamber in a way that a part of the upper portion of the chamber forms the air path.

4. The temperature-controlled tramp metal separation assembly of claim 1, further comprising a first non-magnetic inner tube and a second non-magnetic inner tube wherein the first non-magnetic inner tube is disposed within the first part of the core rod and abuts against a first side of the magnetic set, and the second non-magnetic inner tube is disposed within the third part of the core rod and abuts against a second side of the magnetic set.

5. The temperature-controlled tramp metal separation assembly of claim 1, further comprising a temperature sensor disposed on the housing and coupled with the cooling air transmitting unit in a way that when the operating temperature of the housing is equal to or greater than a first predetermined temperature, the temperature sensor will produce a first signal to actuate the cooling air transmitting unit for introducing external cooling air flow into the air path, and when the operating temperature of the housing is equal to or lower than a second predetermined temperature, the temperature sensor will produce a second signal to stop the cooling air transmitting unit from introducing external cooling air flow into the air path.

6. The temperature-controlled tramp metal separation assembly of claim 5, wherein the temperature sensor is mounted on a part of the first side wall located in the feeding area of the housing.

7. The temperature-controlled tramp metal separation assembly of claim 1, wherein the core rods and the sleeve tubes are divided into a plurality of groups, each of the groups is arranged in a way that each of the core rods and each of the sleeve tubes thereof is are parallel to each other in a horizontal plane, and each of the horizontal planes is spaced apart such that the core rods and the sleeve tubes are provided in a staggered configuration to ensure contact of the raw materials with the first and second portions of the sleeve tubes; the cooling air transmitting unit includes an air introducing member with external cooling air suppliers, an air diverter having a plurality of output ends connected respectively to the air inlet of each of the core rods, and a controlling member operatively connected to the air introducing member and the air diverter.

* * * * *